United States Patent [19]

Eaton et al.

[11] 4,124,408

[45] Nov. 7, 1978

[54] METHOD OF REMOVING DEPOSITS ON REFRIGERATION SYSTEM SURFACES

[75] Inventors: Harold G. Eaton, Lanham, Md.; David L. Venezky, Fairfax, Va.

[73] Assignee: The United States of America as represented by the Secretary of the Navy, Washington, D.C.

[21] Appl. No.: 802,707

[22] Filed: Jun. 2, 1977

[51] Int. Cl.[2] ..... B08B 3/08

[52] U.S. Cl. ..... 134/3; 134/38; 134/39; 134/41

[58] Field of Search ..... 134/3, 41, 22 R, 22 C, 134/28, 38, 39, 40, 2; 252/82, 142, 544, 546, 8.55 B, 8.55 C, DIG. 11

[56] References Cited

U.S. PATENT DOCUMENTS

| | | | |
|---|---|---|---|
| 2,356,254 | 8/1944 | Lehmann et al. | 134/40 UX |
| 3,391,084 | 7/1968 | York | 134/40 X |
| 3,481,870 | 12/1969 | Cheng et al. | 252/8.55 B X |
| 3,664,870 | 5/1972 | Oberhofer et al. | 134/3 |
| 3,684,720 | 8/1972 | Richardson | 134/2 X |
| 3,721,629 | 3/1973 | Goodenough | 134/3 X |
| 3,826,312 | 7/1974 | Richardson et al. | 252/8.55 C X |

OTHER PUBLICATIONS

Pfizer Co., Inc., "Pfizer Aminocarboxylic Chelating Agents", (Data Sheet No. 605), 1963, p. 12.

*Primary Examiner*—Marc L. Caroff
*Attorney, Agent, or Firm*—R. S. Sciascia; Philip Schneider; Thomas McDonnell

[57] ABSTRACT

A polymeric residue with one or more metals, salts, and oxides mixed therein, deposited on refrigeration system surfaces by a circulating halogenated hydrocarbon refrigerant, is removed from a surface by contacting the residue with a saturated aqueous solution or slurry with a pH from 2 to 4 of ethylenediaminetetraacetic acid at temperatures from 30° C to 100° C.

7 Claims, No Drawings

METHOD OF REMOVING DEPOSITS ON REFRIGERATION SYSTEM SURFACES

BACKGROUND OF THE INVENTION

The invention pertains generally to cleaning methods and especially to methods for removing residues produced in refrigeration systems.

Refrigeration systems operate by alternately compressing and vaporizing a refrigerant, such as trichlorofluoromethane ($CFCl_3$). Usually, a small amount of compressor oil is admixed with the refrigerant. Also to be found with the circulating refrigerant are small amounts of water, air, metal (e.g., iron, aluminum, and copper), and oxides and salts of those metals. During the operation of the refrigeration systems, these materials slowly react and accumulate on the surfaces, such as, walls and impeller blades of the refrigeration system. This residue resembles varnish or coke. It is these polymers and halogenated polymers with metals, salts, and oxides admixed therein that render cleaning refrigeration systems nearly impossible.

Presently, several chemical techniques are used, e.g., solutions of citric acid, salts of ethylenediaminetetraacetic acid, modified solutions of hydrochloric acid or phosphoric acid. The major disadvantages associated with the use of these cleaning solutions are poor cleaning and surface corrosion.

SUMMARY OF THE INVENTION

It is therefore an object of this invention to effectively clean refrigeration systems.

Another object of this method is to remove polymeric and halogenated polymeric residues from metallic surfaces quickly, effectively, and with little corrosion of the surface.

These and other objects are achieved by contacting a polymeric residue having one or more salts, metals, and oxides mixed therein with a saturated aqueous solution with a pH from about 2 to about 4 of ethylenediaminetetraacetic acid (EDTA) at a temperature from about 30° to about 100° C.

DETAILED DESCRIPTION OF THE INVENTION

The surfaces inside a refrigeration system consist of a wide range of materials. In view of this situation, the cleaning composition of this invention was tested and found to be completely non-corrosive or only slightly corrosive to surfaces made of stainless steel, carbon steel, copper, brass, a silver alloy, aluminum, polyethylene, polyvinyl chloride. Obviously, many other surfaces could have been tested and found corrosion-resistant to ethylenediaminetetraacetic acid.

To clean a refrigeration system, the refrigerant is drained from the system. A saturated aqueous solution of ethylenediaminetetraaectic acid (EDTA) having a pH from about 2 to about 4, preferably from 2 to 3, and most preferably from 2 to 2.5 is circulated through the system. The water is preferably demineralized or nearly demineralized. A surfactant may also be added to the solution in an amount of at most about 1 weight percent of the total solution weight. The surfactant should be nonionic with an HLB number from about 13 to about 13.5. Exemplary of surfactants are octylphenoxypolyethoxyethanol, ethoxylated octylphenol, and ethoxylated castor oil. In the description of the present invention, a saturated solution is intended to include a slurry, i.e,, a saturated solution with additional solute. The pH and the saturation of the solution are maintained by occasionally adding ethylenediaminetetraacetic acid to the solution. Monitoring the pH provides a convenient method of determining the progress of the cleaning. As the solution removes the residue, the pH increases and when pH remains constant at a low value the refrigeration system is cleaned.

The temperature of the solution should be in excess of room temperature (30° C.) in order to have a desirable cleaning rate, but not too much in excess of 100° C. because of the increased corrosion of the surfaces. Preferably, the temperature is from 55° to 85° C. and most preferably, the temperature is from 65° to 80° C. The temperature may be maintained by any means. One possible technique is to circulate the cleaning solution through a thermostated container filled with the solution and an excess of solid ethylenediaminetetraacetic acid (EDTA).

The aqueous saturated ethylenediaminetetraacetic acid (EDTA) solution is circulated through the refrigeration system until the system is clean. For other applications, e.g., cleaning bilges, the method of this invention can be easily modified to meet any new requirements. What is important is the temperature and concentration of the aqueous EDTA solution. The solution does not have to move across or flush a surface in order for the present invention to work, but faster results are obtained if there is this movement or flushing. Hence if an object is submerged in a saturated aqueous solution of EDTA, it should be agitated in some manner for the fastest results.

After the system is clean, the EDTA solution is drained out and the system is flushed with water or with slightly alkaline buffered water and water in sequence. Thereafter, the system is dried by passing warm air through it.

In order to demonstrate the improvement provided by the method of this invention and the effect of varying the condition of the present method, the following experiments were conducted. It is understood that the results to follow are presented by way of illustration and are not meant to the disclosure or the claims to follow.

Experiment I: Residue Removal Comparison

Weighted portions of residue obtained from a refrigeration system were added to stirred aqueous solutions at various times and temperatures. At the completion of each reaction, the solution was filtered. The residue was then dried and reweighed to determine the percentage of residue removed. The results are shown in Table I.

TABLE I

| Sample | Cleaning Agent | Initial pH | Final pH | Amount in Solution, wt% | Conditions |
|---|---|---|---|---|---|
| 1 | Ammonium citrate (controlled pH) | 2.4 | 2.5 | 78 | Heated and stirred at 70° C for 2 hours. pH readjusted after 1 hour. |
| 2 | Citric Acid | 2.2 | 3.6 | 41 | Heated and stirred at 60° C for 1 hour. |
| 3 | Citric Acid | 2.2 | 2.4 | 77 | Heated and stirred at |

TABLE I-continued

| Sample | Cleaning Agent | Initial pH | Final pH | Amount in Solution, wt% | Conditions |
|---|---|---|---|---|---|
| | (controlled pH) | | | | 60° C for 2 hours. pH readjusted after 1 hour. |
| 4 | EDTA, pH adjusted with ammonium hydroxide | 5.3 | 7.8 | 28 | Heated and stirred at 60° C for 1 hour. |
| 5 | EDTA, pH adjusted with ammonium hydroxide (controlled pH) | 3.7 | 2.8 | 81 | Heated and stirred at 70° C for 3 hours, pH readjusted after 1 and 2 hours. |
| 6 | EDTA, Tetrasodium salt | 10.8 | 10.8 | 16 | Heated and stirred at 60° C for 1 hour. |
| 7 | EDTA, Disodium salt | 4.6 | 8.4 | 28 | Same as above. |
| 8 | EDTA, saturated with an excess of acid | 2.7 | 2.4 | 91 | Heated and stirred at 70° C for 2 hours. pH readjusted after 1 hour. |

Experiment II: Corrosion Comparison

Samples of 50% carbon steel type 515, red brass, a copper-nickel alloy, copper, and a silver alloy were placed in cleaning solutions. Residue obtained from a refrigeration system was added to each solution in an amount of approximately three weight percent of the total weight of solution. Under these conditions only the steel showed any appreciable weight loss. All of the non-steel samples exhibited less than a 0.5 weight percent loss. The loss in weight percent of the steel sample along with the loss in weight percent of the residue in parenthesis is listed in Table II.

TABLE II

| | Time = 24 hours Temperature | | | Time = 48 hours Temperature |
|---|---|---|---|---|
| Cleaning Agent | 60° C | 70° C | 80° C | 80° C |
| Citric Acid | 10(75) | 8(82) | 10(84) | 22(84) |
| EDTA | 5(84) | 7(90) | 12(91) | 12(91) |

The 90 weight percent loss of residue and approximately 7 weight percent loss of the most susceptible metal demonstrate that the method of this invention provides a highly effective technique for cleaning residues from refrigeration systems and other apparatus and constructions. The one- or two-hour cleaning times of TABLE I show the practicality of this method.

Obviously many modifications and variations of the present invention are possible in light of the above teachings. It is therefore to be understood that within the scope of the appended claims the invention may be practiced otherwise than as specifically described.

What is claimed and desired to be secured by Letters Patent of the United States is:

1. In a method of removing deposits on a refrigeration system surface, said deposits being formed by passing a halogenated hydrocarbon refrigerant mixed with minor amounts of water, air, and compressor oil through the system in contact with metals and metallic compounds within the system, the improvement comprising a. contacting at a temperature from about 30° to about 100° C. said surface with an aqueous solution saturated with ethylenediaminetetraacetic acid and with a pH from about 2 to about 4; and b. removing said saturated solution from said surface.

2. The method of claim 1 wherein said temperature is from 55° to 85° C. and said solution has a pH from 2 to 3.

3. The method of claim 1 wherein said temperature is from 65° to 80° C. and said saturated aqueous solution has a pH from 2 to 2.5 and further comprises a surfactant.

4. The method of claim 3 wherein said surfactant is nonionic with an HLB number from about 13 to about 13.5.

5. In a method of removing deposits on a refrigeration system surface, said deposits being formed by passing a halogenated hydrocarbon refrigerant mixed with minor amounts of water, air, and compressor oil through the system in contact with metals and metallic compounds within the system, the improvement comprising a. flushing, at a temperature from about 30° C. to about 100° C., said surface with an aqueous solution saturated with ethylenediaminetetraacetic acid and with a pH from about 2 to about 4 until the pH remains constant;

b. removing said saturated aqueous solution from said surface; and c. drying said surface.

6. The method of claim 5 wherein said temperature is from 55° C. to 85° C. and said solution has a pH from 2 to 3.

7. The method of claim 5 wherein said temperature is from 65° C. to 80° C. and said saturated aqueous solution has a pH from 2 to 2.5 and further comprises a nonionic surfactant with an HLB number from about 13 to about 13.5.

* * * * *